United States Patent [19]

Marshall

[11] Patent Number: 4,470,818

[45] Date of Patent: Sep. 11, 1984

[54] THERMAL SIGHT TRAINING DEVICE

[75] Inventor: Albert H. Marshall, Orlando, Fla.

[73] Assignee: The United States of America as represented by the Secretary of the Navy, Washington, D.C.

[21] Appl. No.: 433,580

[22] Filed: Oct. 12, 1982

[51] Int. Cl.[3] ..... F41G 3/26

[52] U.S. Cl. ..... 434/22; 273/348.1

[58] Field of Search ..... 434/16–22; 273/348, 348.1, 310, 312

[56] References Cited

U.S. PATENT DOCUMENTS

| | | | |
|---|---|---|---|
| 3,240,924 | 3/1966 | Darby | 273/310 |
| 3,798,796 | 3/1974 | Stauff | 434/20 |
| 3,907,433 | 9/1975 | Nault | 434/22 |
| 4,086,711 | 5/1978 | Gammarino et al. | 273/310 |
| 4,279,599 | 7/1981 | Marshall et al. | 273/348.1 |
| 4,340,370 | 7/1982 | Marshall et al. | 434/22 |
| 4,416,630 | 11/1983 | Hagen et al. | 434/16 |

*Primary Examiner*—Richard C. Pinkham
*Assistant Examiner*—Leo P. Picard
*Attorney, Agent, or Firm*—Robert F. Beers; Robert W. Adams; Robert J. Veal

[57] ABSTRACT

A training system simulates thermal sight presentations utilizing miniature targets which have been painted with retroreflective paint in predetermined patterns corresponding to the thermal radiation associated with the target. The target is viewed through a telescope upon which a light source is mounted, light from said source being reflected into said telescope by the retroreflective paint. A pressure actuated switch in the eyecup of said telescope energizes said light source and background illumination. The system is designed for use with a simulated weapon and includes a TV camera mounted on said weapon with an associated light source for illuminating said target, thereby providing trainee monitoring capabilities.

16 Claims, 1 Drawing Figure

THERMAL SIGHT TRAINING DEVICE

BACKGROUND OF THE INVENTION

Thermal imaging enables the military to see through smoke and to fight at night as well as in the day. The thermal images correspond to the heat patterns of the viewed scene instead of the reflected light pattern that day optics use. In order to rapidly integrate this capability to the troop level, there is an ongoing requirement to provide low cost thermal sight training.

The use of heat-responsive sighting equipment requires special training, because the image presented by such a device is of a different character than that perceived with visible light. Accordingly, it is necessary to afford extensive night time-like practice to personnel who are expected to use such equipment, in order to develop their ability to detect targets and to recognize objects of the type at which they may have to fire in actual combat. For such training it is necessary to have targets which will simulate heat radiation patterns that realistically depict specific objects at which combat fire might be aimed.

Training practices in the past have employed infrared sources that range from the object itself to pyrotechnic devices. U.S. Pat. No. 4,240,212 employs electrically resistive material strategically placed on a form and energized to create an infrared signature that realistically simulates an object. U.S. Pat. No. 4,253,670 utilizes plywood construction with an internal heating source such as charcoal or kerosene.

U.S. Pat. No. 4,279,599 teaches selective etching of a plate target to imitate the thermal signature of the simulated target.

All of the above cited patents are primarily concerned with actual weapons fire and/or range terrain engagement using full scale weaponry. While actual combat conditions are certainly the most useful for training, such conditions are also the most costly and most hazardous not only to targets but to personnel and equipment, as well. Further, each of the above calls for the use of actual thermal sights, even in a peaceful environment, and such sights are not inexpensive. Such training also requires transportation to a training area and in many cases tanks and crews which are extremely expensive.

SUMMARY OF THE INVENTION

It is an object of the present invention to provide a realistic thermal sight training scenario which will provide training transfer to the equipment and conditions simulated.

It is a further object of the invention to provide a training scenario which can be used indoors in all weather to simulate night time battlefield conditions.

It is yet another object of this invention to provide a low cost thermal sight training system incorporating the above objects.

These and other objects and advantages are successfully embodied in the invention by the use of miniature models on a terrain board. The models are painted with retroreflective paint in accordance with the thermal signature of the target they simulate. A simple sight with a rear optical axis source of light mounted thereon serves to illuminate the model such that a pseudo-thermal signature is viewed.

The features of the invention desired to be protected are set forth in the appended claims. The invention itself, together with further objects and advantages thereof may best be understood by referring to the following description taken in conjunction with the appended drawings.

BRIEF DESCRIPTION OF THE DRAWINGS

The figure is a block diagram type representation of the thermal sight trainer system.

DESCRIPTION OF A PREFERRED EMBODIMENT

Figure 1:
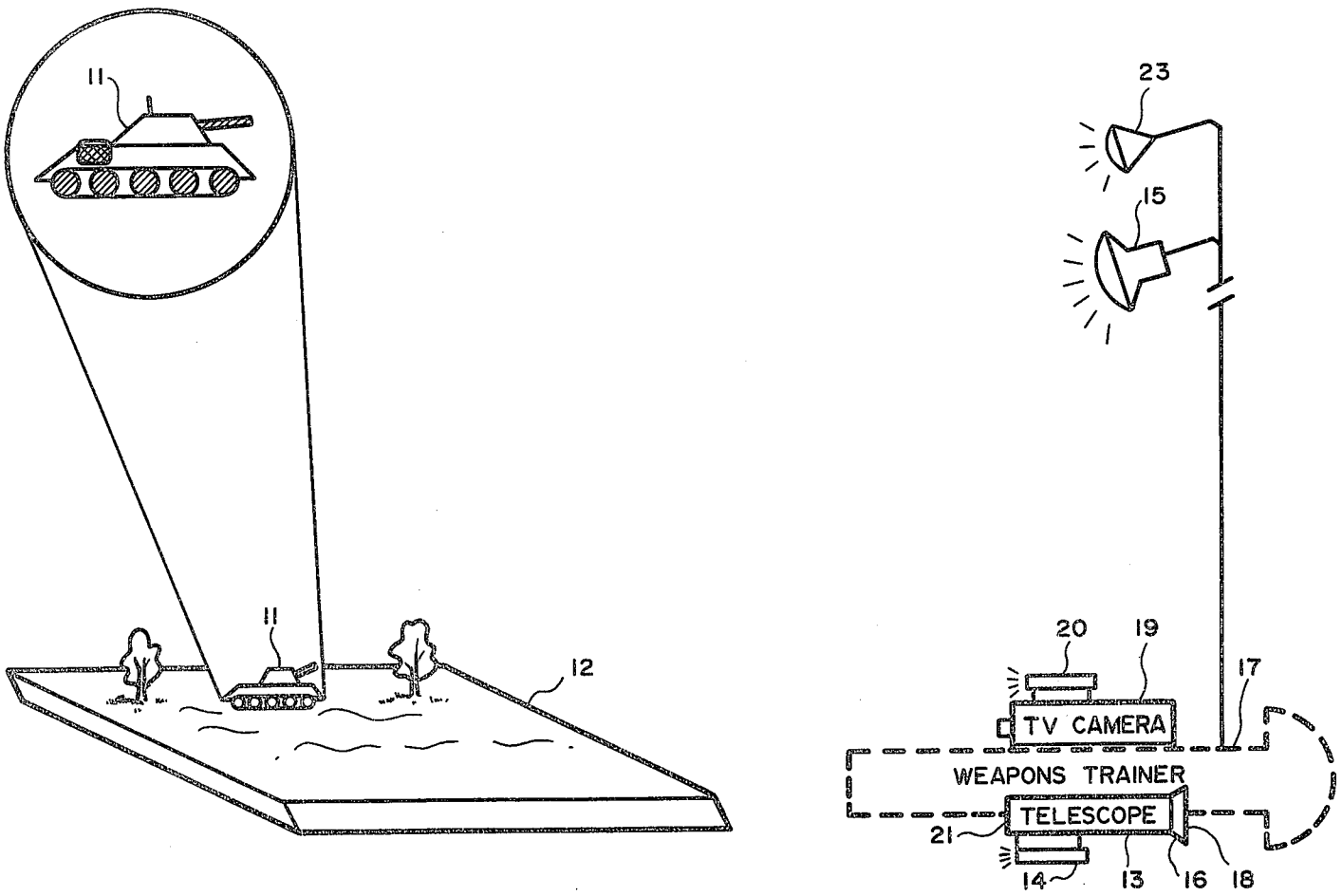

The present invention is designed to be used with weapons systems simulators such as the device disclosed in U.S. patent application Ser. No. 338,698, filed Jan. 11, 1982 by Albert H. Marshall et al. The device disclosed therein is a computer controlled simulator which allows the user to experience near-actual weapons fire conditions within a limited space and at a low cost compared to live fire.

Referring to the figure, a miniature model 11 moves about a terrain board 12. Model 11 may represent any target which might be encountered in combat. Model 11 is painted with retroreflective paint in the areas which emit the greatest IR energy, i.e., the hottest areas. By way of illustration, the cross-hatched areas of the inset could be heavily painted. The paint can be applied in whatever pattern is desired to produce a pseudo-thermal signature when model 11 is illuminated. The trainee uses a simple telescope 13 with the same magnification as the real device to view model 11. Telescope 13 is mounted to the weapons trainer 17. Telescope 13 has an eyecup 18 against which the trainee places his eye to view model 11. Integral to eyecup 18 is a pressure sensitive switch 16, which may be any one of a number of varieties as are well known in the art, which is closed by the force of the trainee's face against eyepiece 18.

Closure of switch 16 provides a current path from an electrical source, not shown, to a small directional light 14, such as a penlight, which is mounted on telescope 13 and which is directed parallel to said telescope 13. The illumination from light 14 is reflected along and near the optical axis between light 14 and model 11 by the retroreflective paint thereon, thus a reflected light pattern corresponding to the pattern of retroreflective paint on the target can be seen by the trainee through telescope 13. Because the light is retroreflected back from the target, the trainee can only see it through the telescope. He thus thinks the telescope is a thermal sight.

Inasmuch as the training is carried on in a darkened room and the actual firing of weapons trainer 17 is electrically simulated, the instructor needs to be able to view the training evolution remotely. This is accomplished by the use of a boresighted TV camera 19 mounted on weapons trainer 17. To insure that the pattern is visible in the camera, a second light 20 is located proximal to camera 19 such that the light therefrom will be reflected from model 11 to camera 19. Again, only the TV can see reflection from light 20.

An actual thermal sight will have a phosphorescent background color which can be provided by either illuminating the room with a low level floodlight 15 of either red or green color, or by placing a red or green filter 21 in the optical path, with the color depending on the phosphorescent material simulated. A flash may be introduced by an offset flash lamp 23 to simulate battle flashes. Lamps 23 and 15, and lights 14 and 20 would all be turned on by pressure sensitive switch 16.

In operation the selected target would be represented by model 11 with the appropriate pattern of retroreflective paint applied thereto. Model board 12, weapons trainer 17, and the trainee would all be in a darkened room. The trainee commences the exercise by positioning himself for operating the weapons trainer 17. In order to look through telescope 13 he must close switch 16, built into eyepiece 18, which turns on background floodlight 15 and lights 14 and 20, as well as flash lamp 23. The retroreflective pattern painted on model 11 presents a pseudo-thermal target which, when viewed through telescope 13 or camera 19, closely approximates the view through an actual thermal sight. The target pattern may easily be changed to present a variety of training encounters by replacing model 11 with a different model on which a different thermal pattern has been painted.

It will be appreciated that although the present invention has been described in a particular embodiment, the teachings herein may be applied to a number of weapons systems upon which thermal sight training will be undertaken. Furthermore, the foregoing description relates only to the typical embodiment of the invention. It will be readily apparent to one skilled in the art that minor variations may be made without departing from the spirit of the invention, and it is therefore intended that the invention not be limited to the specifics of the preceding description but rather embrace the full scope of the following claims.

What is claimed is:

1. A thermal sight simulation system for use by trainees with weapons training devices, comprising:

means for simulating targets;

means for imparting simulated thermal signature characteristics on said target simulating means through the use of retroreflective paint, said signature characteristics being viewable only over a prescribed arc;

telescopic sighting means for viewing said target simulating means in conjunction with use of said training devices;

means for illuminating said target simulating means from a point near said sighting means such that said thermal signature characteristics remain visible for so long as said sighting means is directed towards said target simulating means; and means for providing background illumination about said target simulating means.

2. The system of claim 1, wherein said target simulating means are miniature models of various vehicles.

3. The system of claim 1 wherein said sighting means is a telescopic sight, having an eyecup.

4. The system of claim 1, wherein said illuminating means comprises small directional electrical light source and a source of electricity connected thereto, and filter means disposed along the optical path between said illuminating means and said sighting means.

5. The system of claim 4, wherein said illuminating means further comprises an actuating switch connected between said light source and said source of electricity, said switch providing a current path therebetween when engaged by said trainee.

6. The system of claim 5, wherein said actuating switch is a pressure sensitive switch mounted on said sighting means such that said switch is closed by the trainee's use of said sighting means.

7. The system of claim 4, wherein said light source is a low intensity penlight mounted adjacent to said sighting means.

8. The system of claim 1, wherein said means for providing background illumination is a low intensity floodlight of a color corresponding to the background as viewed through an actual thermal sight.

9. The system of claim 1, further comprising means for remotely monitoring said trainee's performance.

10. The system of claim 9, wherein said monitoring means comprises:

a television camera mounted on said weapons training device and boresighted thereto; and a small directional light source mounted on said camera such that said light source illuminates said target simulating means.

11. The system of claim 1, further comprising flash lamp means for simulating distant battle flash.

12. A thermal sight simulation system for use by trainees with weapons training devices, comprising:

means for simulating targets;

sighting means for viewing said target simulating means in conjunction with use of said training devices;

means for illuminating said target simulating means proximal said sighting means;

means for imparting simulated thermal signature characteristics on said target simulating means, said signature characteristics being viewable only over a prescribed arc about a direct line between said target simulating means and said sighting means, said signature characteristics being formed by retroreflective paint selectively applied in heavier concentration on said target simulating means in correspondence with the areas of a real target which generate and radiate the most heat; and means for providing background illumination about said target simulating means.

13. A thermal sight simulation system for use by trainees with weapons training devices, comprising:

means for simulating targets by miniature models thereof;

sighting means for viewing said target simulating means in conjunction with use of said training devices;

means for illumminating said target simulating means located proximal said sighting means;

means for imparting simulated thermal signature characteristics on said target simulating means by the use of retroreflective paint which is applied to said miniature models such that the areas corresponding to the hottest areas of the real target simulated by said model are coated most heavily by said paint; and means for providing background illumination about said target simulating means.

14. A thermal sight simulation system for use with weapons training devices, comprising in combination:

a plurality of interchangable miniature vehicles modeled after actual combat vehicles, said miniature vehicles having painted thereon varying patterns and thicknesses of retroreflective paint, said patterns and thicknesses corresponding to the actual thermal emission pattern of said modeled vehicle, said retroreflective paint having a high optical reflectance over a limited arc;

a terrain board located distal to said weapons training device, said terrain board providing the operating area for said miniature vehicles;

a telescopic sight mounted on said weapons training device for aligning said device with a selected miniature vehicle, said sight having an optical power such that said miniature vehicle appears as an actual combat vehicle at a distance, said telescope having an eyepiece for viewing therethrough;

means for providing a low level directional light source, mounted on said telescopic sight and directed parallel thereto;

means for providing background illumination for said terrain board and said miniature vehicle, said background illumination simulating the phosphor background of a thermal sight; and filter means for tinting reflections of said directional light source from said retroreflective paint pattern, in accordance with said background illumination.

15. The system of claim 14, further comprising:

a TV camera for sending images to a remote location, said camera mounted on said weapons training device and boresighted thereto; and a low level directional light source mounted on said camera and directed parallel thereto.

16. The system of claim 14, further comprising flash lamp means for providing a background battle flash.

* * * * *